United States Patent [19]

Anders et al.

[11] Patent Number: 5,060,772

[45] Date of Patent: Oct. 29, 1991

[54] POWER-OPERATED TOOL

[75] Inventors: Heinz-Gerhard Anders, Aalen; Eugen Mattheiss, Lauchheim; Dieter Weimer, Aalen, all of Fed. Rep. of Germany

[73] Assignee: Cooper Industries, Inc., Houston, Tex.

[21] Appl. No.: 394,404

[22] Filed: Aug. 15, 1989

[30] Foreign Application Priority Data

Aug. 17, 1988 [DE] Fed. Rep. of Germany ..... 3827840

[51] Int. Cl.[5] ..... B25B 23/145

[52] U.S. Cl. ..... 192/0.034; 192/56 R; 192/150; 173/12; 81/470

[58] Field of Search ..... 192/0.034, 56 R, 67 A, 192/150; 173/12; 81/470

[56] References Cited

U.S. PATENT DOCUMENTS

| | | | |
|---|---|---|---|
| 3,168,944 | 2/1965 | Livermont | 192/56 R |
| 3,205,992 | 9/1965 | Clapp | 192/150 |
| 3,289,715 | 12/1966 | DeGroff et al. | 192/150 X |
| 3,752,278 | 8/1973 | States | 192/56 R |
| 3,811,513 | 5/1974 | Wezel et al. | 173/12 |
| 3,993,145 | 11/1976 | Findeli | 173/12 |
| 4,154,308 | 5/1979 | Goldsberry et al. | 173/12 |
| 4,576,270 | 3/1986 | Baltz et al. | 192/150 |
| 4,631,992 | 12/1986 | Eckman | 81/470 |

*Primary Examiner*—Richard Lorence

*Attorney, Agent, or Firm*—Donald J. Verplancken; David A. Rose

[57] ABSTRACT

The power-operated tool, preferably a screw driving implement, includes a switching clutch which transfers the torque from the drive shaft to the output shaft. Upon reaching the given reactive maximum torque, the switching mechanism is activated to turn off the drive. The clutch components are still engaged, so that one torque is transferred to the screw after the unit is turned off. This allows for unsupervised motion upon the output shaft. One should be able to interrupt the torque transfer to the output shaft completely and to return the switching clutch to its original position with certainty and ease. The switching mechanism maintains the valve body of the on-off valve in the open position, with the clutch component of the separating clutch separated by at least one buffer. In this way, the drive shaft continues to operate, allowing the clutch component to return to its original position where it engages the other clutch component of the separating clutch, even following interruption of the torque transfer. The power-operated tool may be designed as a hand-operated screw driver or as a multiple screw driver.

14 Claims, 5 Drawing Sheets

POWER-OPERATED TOOL

BACKGROUND OF THE INVENTION

The invention concerns a power-operated tool, and more particularly a screw driving implement.

BRIEF SUMMARY OF THE INVENTION

This familiar tool (DE-PS 28 32 565) provides for the transfer of torque from the drive shaft to the output shaft via the switching clutch. The clutch component located on the output side is coupled with the output shaft via balls. The balls sit in specially designed grooves in the output shaft and in pockets of the clutch component on the output side. When the tool is used to drive bolts, the balls travel in the grooves with increasing reactive torque. Since they gather in the direction of rotation, the clutch component on the side of the output shaft is displaced axially in the direction of its separated position under increasing reactive torque. When the given reactive torque is reached, the switching mechanism is activated, which turns the drive off. At this time the clutch components of the switching clutch are still engaged, so that even after the drive is turned off torque is transferred to the screw. In the process, a slight increase in torque is even realized, with the clutch component on the output side displaced axially such that it no longer engages the other clutch component. Only at this point is the torque transfer interrupted. Since the torque still works on the output shaft after the drive is turned off, unsupervised motion on the output shaft can occur.

The invention is a response to the task of designing a generically appropriate tool such that when the tool is turned off the torque transfer to the output shaft is completely interrupted and the switching clutch able to be returned to its original position with certainty and ease.

When the tool, in accordance with invention, reaches reactive maximum torque and the one clutch component of the switching clutch moves to the separated position, the buffer prevents the valve body of the on-off value from moving into the closed position. Instead, the switching mechanism maintains the valve body in the open position, allowing the drive shaft to continue to operate. This guarantees that even after the torque transfer is interrupted, the clutch component, once in the separated position, is returned to its original position where it engages the other clutch component of the switching clutch. In this way the tool can be started again anew immediately following the operation. The tool is best suited for use as a pneumatic screw driving implement for tightening screws, bolts, nuts and the like. A consequence of the design made in accordance with the invention is the reliable guarantee that even in the case of soft screws the clutch component, in the separated position, returns again securely to the engaged position following interruption of the torque transfer.

Additional features of the invention can be seen from the further claims, the description, and the drawings.

BRIEF DESCRIPTION OF THE DRAWINGS

The invention is elaborated in more detail by using one of the operations depicted in the drawings. Shown are.

DETAILED DESCRIPTION OF THE PREFERRED EMBODIMENTS

Figure 1:
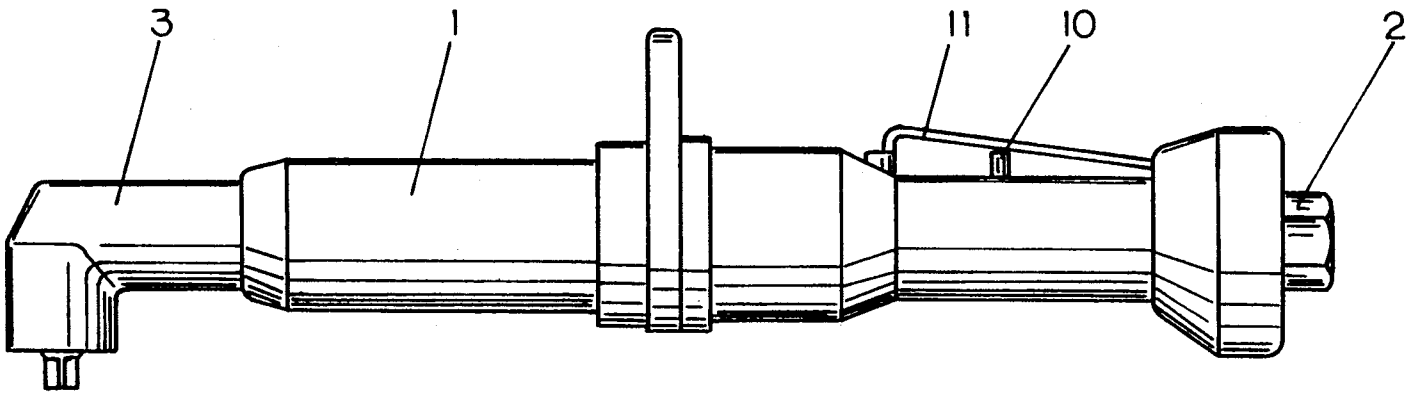
FIG. 1 a power-operated tool in accordance with invention, frontal view.

The power-operated tool represented in the drawings is a pneumatic screw driving implement which can be designed as a hand-operated screw driver or as multiple screw driver.

Figure 2:
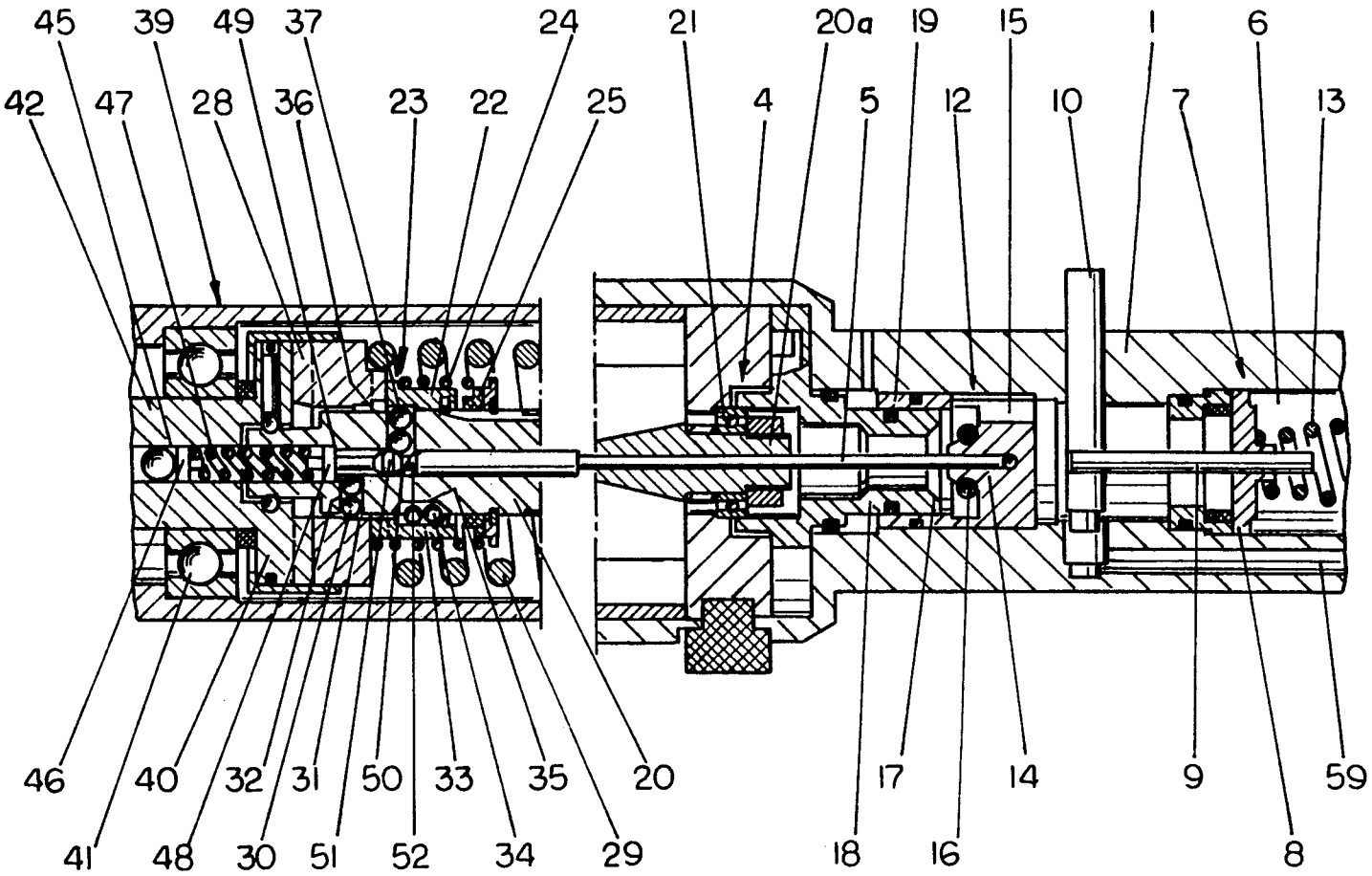
FIG. 2 axial section of one portion of the tool as in FIG. 1.
Figure 3:
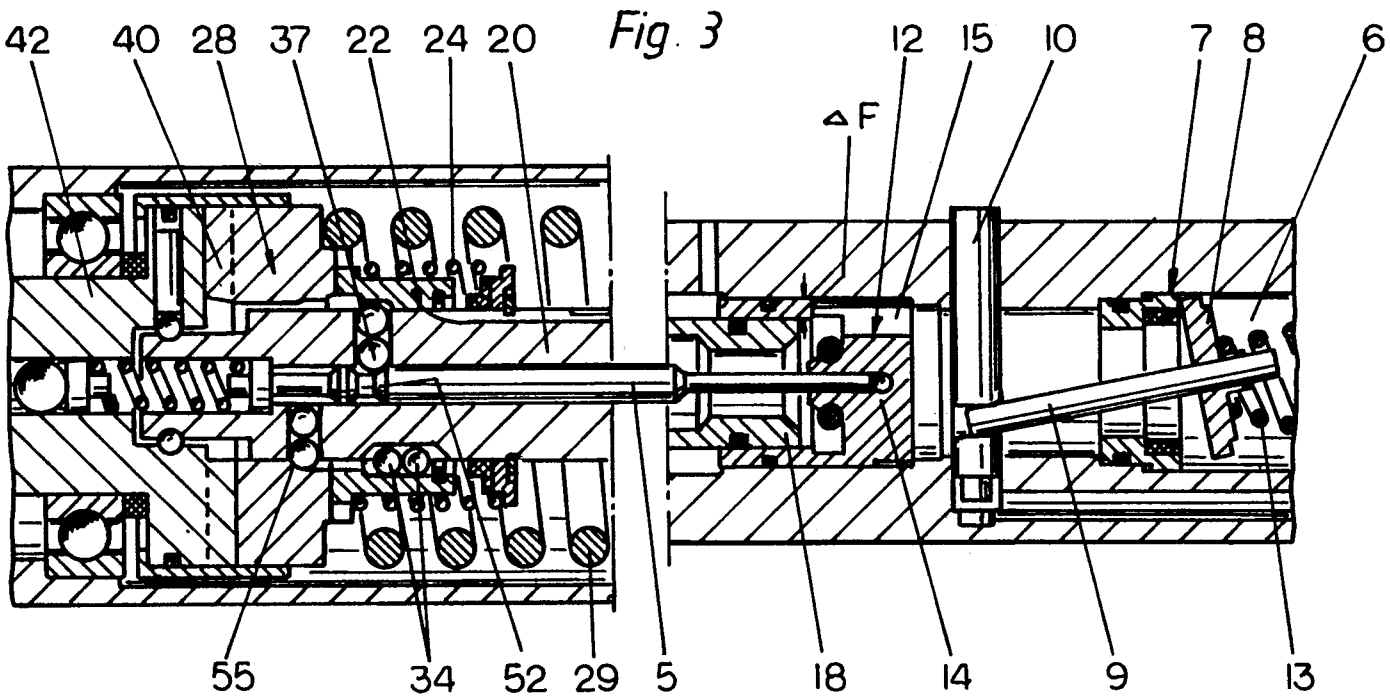
FIG. 3 enlarged axial section of one portion of the tool in accordance with invention, in operation, FIG. 3*a* schematic representation of the point of contact between the components of a switching clutch of the tool in accordance with invention, in operation as shown in FIG. 3, FIG. 3*b* representation corresponding to FIG. 3*a*, components of a separating clutch of the tool in accordance with invention, in operation, FIG. 4 axial section of one portion of the tool in accordance with invention, with switching clutch disengaged, FIG. 4*a* the point of contact of the tool's switching clutch, positioned as shown in FIG. 4, FIG. 5 axial section of one portion of the tool in accordance with invention, with switching clutch disengaged, FIG. 5*a* the point of contact of the tool's separating clutch, positioned as shown in FIG. 5.

Referring initially to FIGS. 1 and 2, the screw driving implement has a housing 1 equipped on one end with a fitting 2 for compressed air and on the other end with an output section 3 on which a screwing implement, a plug nut or something similar can be positioned. A pneumatic motor 4 is located in the housing 1 which is interspersed centrally with a switching ram 5. The compressed air can flow through a channel 6 to the pneumatic motor 4. When the pneumatic motor is turned off, the channel 6 is closed toward the motor side by a valve 7, the valve heads 8 are positioned on a valve spindle 9 which is arranged concentrically to the switching ram in the housing 1. The valve spindle 9 is connected to a ram 10 running laterally to its x-axis, which latter protrudes from the housing and can be moved in the direction of its axis with a lever 11 (FIG. 1). If the lever 11 is depressed, the ram 10 is moved into the housing 1, causing the valve head 8 to tip into an open position by means of the valve spindle 9 (FIG. 3). The compressed air can then flow from the channel 6 through the opened valve 7 to an on-off valve 12. The valve head 8 is held by a compression spring 13 under tension in the direction of its closed position.

The on-off valve 12 has a valve body 14 seated on one end of the switching ram 5. The valve body 14 leads to the interior walls of the housing 1 and has flow-through openings 15 for the compressed air. The compressed air can then reach the pneumatic motor 4 through these flow-through openings 15. In the off-position, the valve body 14 comes to form a seal 16 (FIG. 5) with a valve seat 17 of a sleeve 18. It is interspersed centrally by the switching ram and is positioned securely in the housing 1. The valve body 14 leads to the sleeve 18 with a sleeve fitting 19 moveable axially.

A rotor shaft 20*a* driven by the pneumatic motor 4 protrudes into the sleeve. The rotor shaft 20*a* is supported by bearings 21 inside the housing and can rotate freely. A coil-shaped driver 22 of the separating clutch 23, positioned against the tension of a compression spring 24 on the hollow spindle 20 and adjustable, is seated atop the hollow spindle 20. The compression spring 24 surrounds the driver 22 and is supported by it as well as by a ring 25 secured atop the hollow spindle 20.

On the end facing away from the pneumatic motor 4, the driver 22 has clutch coupling jaws 26 (FIG. 5) which mesh with the front face clutch coupling jaws 27 of a clutch component 28 of the separating clutch 23. It likewise is seated atop the hollow spindle 20, axially adjustable and torqued to it. Clutch component 28 is held in tension by a compression spring 29 (FIG. 2) in the direction of its clutch position. Compression spring 29 surrounds compression spring 24 for the driver 22 with a space in between. The hollow spindle 20 is equipped with at least one stop member or buffer 30 which extends into an impression 31 of clutch component 28 and runs axially. The operation model shows the stop member using balls located in the radial transit drill holes 32 of the hollow spindle 20. The stop members 30 are secured against dislocation through the transit drill holes 32 radially to the outside by clutch component 28 and radially to the inside by the switching ram 5. Additional stop members 30 of this kind can be used around the circumference of the hollow spindle and the clutch component, as needed.

Similarly, the bushing-shaped driver 22 has axial impressions on the interior which mesh with pieces of the clutch 34. These are best designed with the use of balls which also mesh with the impressions 35 of the hollow spindle 20. In order to transfer the torque with certainty from the hollow spindle 20 to the driver 22, it is best to provide in each case two balls 34 in the impressions 33, 35 axially adjacent.

Moreover, the hollow spindle 20 is further equipped with additional radial transit drill holes 36 in which radially adjustable stop members or buffers 37 are positioned. It is best if they likewise consist of balls, secured against falling out radially on the inside by means of the switching ram 5 and radially on the outside by means of the driver 22.

In addition to a separating clutch 23, the tool is also equipped with a switching clutch 39 (FIG. 2), which consists of clutch component 28 as well as clutch component 40 on the output side. It is swivel-mounted with bearings 41 in the housing 1 and is torqued to an output shaft 42, best designed as a single piece with it. The output shaft 42 engages the output component 3 (FIG. 1). The clutch component 40 includes clutch coupling jaws 43 on the front end facing clutch component 28 (FIG. 4) which mesh with the clutch coupling jaws 44 of clutch component 28 on the front end.

Clutch component 40 is equipped with a concentric aperture 45 (FIG. 2) with an abutment 46 inside for one compression spring 47, with which the switching ram 5 is held in tension in the direction of the open position of the on-off valve. The switching ram 5 has a collar 48 for the compression spring 47 which rests close to a relief 49 in the hollow spindle 20 under the tension of the compression spring 47 in the switching ram's starting position (FIG. 2).

With the motor turned off, the parts of the power-driven tool return to the starting position depicted in FIG. 2. The valve body 14 of the on-off valve 12 is lifted from the valve seat. The switching ram 5 is under the tension of compression spring 47 with a collar 48 on the relief 49 of the hollow spindle 20, as described. The driver 22 as well as clutch components 28 and 40 are engaged. The stop members 37 are positioned radially on the inside mesh with a groove 50 of the switching ram 5. The groove 50 is bordered on the side facing the compression spring 47 by a collar 51 with a tapered surface area on both sides. On the other side, the groove 50 is similarly bordered by a tapered surface area 52. Collar 51 is situated opposite collar 48 with a gap between. In the area between these two collars the switching ram 5 has a smaller diameter than the central drill hole of the hollow spindle 20.

Pushing the lever 11 starts the tool (FIG. 1), moving the ram 10 into the housing 1 and opening the valve 7 via the valve spindle 9 (FIG. 3). The compressed air can thus flow from the channel 6 through the opened valve 7 and the through-gap 15 of the valve body 14 toward the pneumatic motor 4. This drives the rotor shaft 20*a* in a rotary motion. The differential surface area ▲ F (FIG. 3) between the sleeve 18 and the valve body 14 with the sleeve component 19 gives rise to a differential pressure when compressed air is admitted, causing the valve body 14 to be moved marginally in the direction of the sleeve 18. In this way the switching ram is advanced until the radially internal ball 37 comes to rest near the tapered surface area 52 and thus prevents the switching ram from moving any farther. This position is shown in FIG. 3.

Figure 3B:
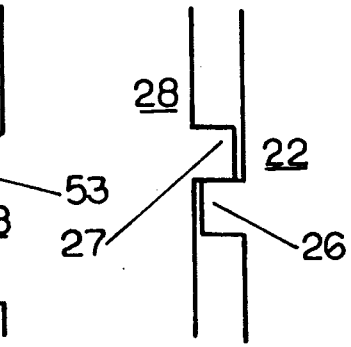
Figure 3A:
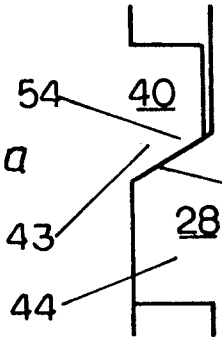

The hollow spindle 20 rotates the driver 22 via clutch components 34. Since the driver 22 meshes with clutch component 28 and the latter with clutch component 40, the output shaft 42 rotates as well. FIG. 3*a* shows how the clutch coupling jaws 44 of clutch component 28 mesh with the clutch coupling jaws 43 of clutch component 40. FIG. 3*b* shows the contact position of the clutch coupling jaws 26 of the driver 22 and the clutch coupling jaws 27 of clutch component 28. The driver 22 and clutch components 28 and 40 mesh, each under tension of the two compression springs 29 and 24.

Figures 4, 4A:
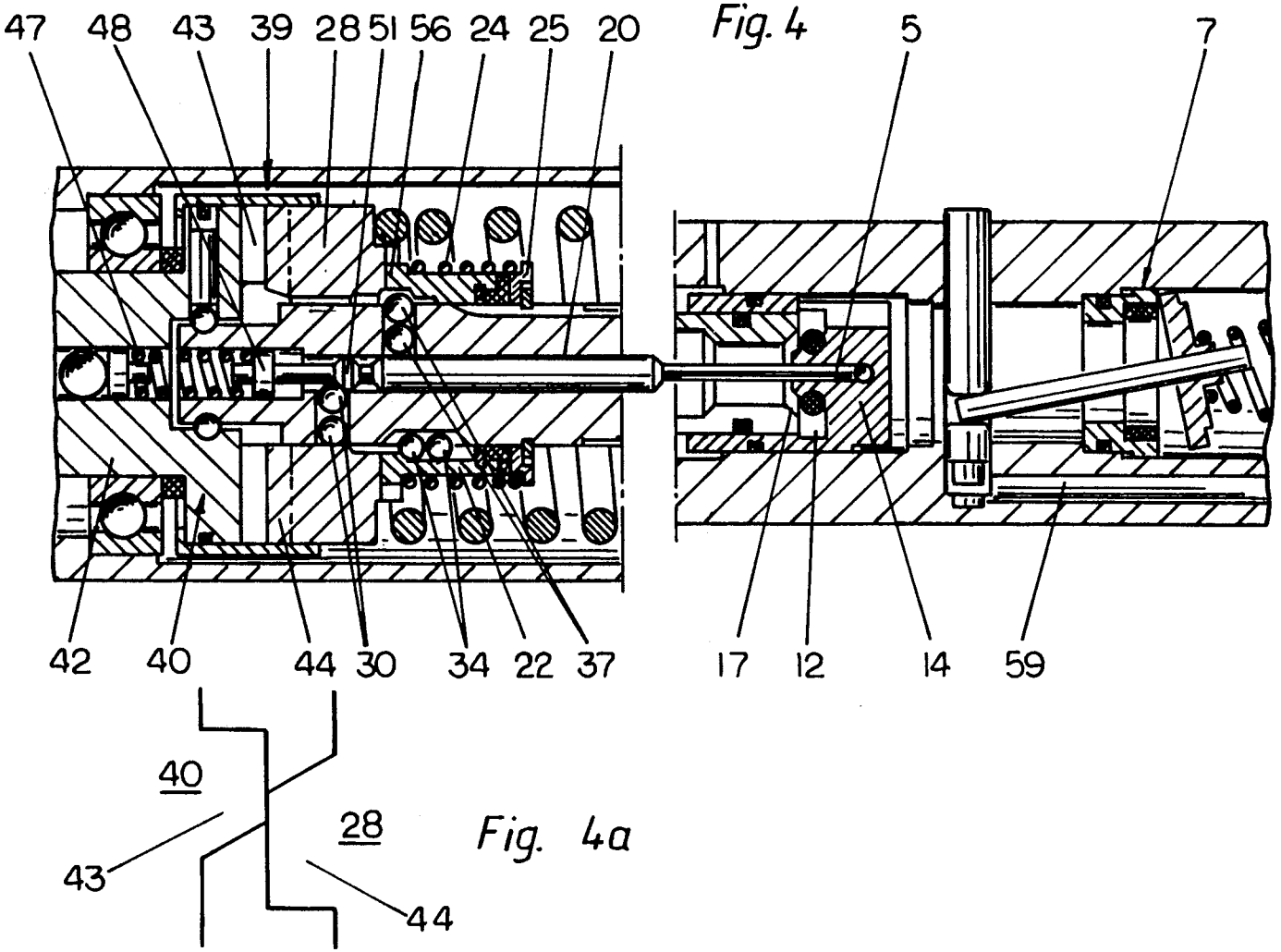

When the tool is used to carry out a screwing procedure, the screw is initially screwed in until the head comes to rest on a base. As the screw is screwed in further, the torque increases, since the screw twists elastically and possibly even undergoes a change in shape toward the end of the screwing procedure. Clutch components 28, 40 and the driver 22 then assume the position shown in FIGS. 3, 3*a* and 3*b*, in which the clutch coupling jaws 43, 44, 26, 27 lie adjacent to each other. The given torque is set via compression spring 29, with which the torque transfer is to be discontinued. For this purpose a nut (not shown) is adjusted which supports compression spring 29. Once the set maximum torque is reached, the power of the compression spring 29 no longer suffices to transfer the torque to clutch component 40 on the output side via the interlocking clutch coupling jaws 43, 44. Clutch component 28 is then twisted relative to clutch component 40. As FIG. 3*a* shows, the clutch coupling jaws 43, 44 have oblique front faces 53 and 54 which are in close proximity when in contact position. When maximum torque is attained, the oblique front faces 53 and 54 of clutch components 28 and 40 slide past one another, causing clutch component 28 to be moved axially against the tension of the compression spring 29 until its clutch coupling jaws 44 are released from the clutch coupling jaws 43 of clutch component 40. Since clutch component 28 remains torqued during this axial displacement via the driver 22 with which it is in contact—which in turn is torqued to the hollow spindle 20 via the clutch pieces 34—clutch component 28 is turned relative to clutch part component 40 as soon as it is released from it. Clutch coupling jaws 44 of clutch component 28 then rest upon the clutch coupling jaws 43 of clutch component 40 (FIG. 4*a*). The torque transfer from the hollow spindle 20 to the output shaft 42 is interrupted at this moment, so that the screw is no longer tightened and cannot be overtightened. The switching clutch 39 thus has the job of interrupting the drive connection to the output shaft 42 when the preset torque is reached.

Since the driver 22 is in contact with clutch component 28, it is also displaced axially along the hollow spindle 20 against the tension of the compression spring 24 during the course of the axial displacement described above, until it comes to rest against the ring 25. The position is shown in FIG. 4. During the screwing procedure, stop members 30—as FIG. 3 shows—rest against a shoulder 55 of clutch component 28. Since the shoulder runs obliquely against the direction of the displacement, the stop members 30 are pushed radially inward during the axial displacement of clutch component 28. The radially inner stop member 30 thus protrudes into the area between the two collars 48 and 51 of the switching ram 5 and in so doing prevents the switching ram 5 from being displaced—under the differential pressure acting upon the valve body 14 against the tension of the compression spring 47—to such an extent that the on-off valve 12 closes. As FIG. 4 shows, the on-off valve 12 is still open when the switching ram 5 approaches the stop member 30, allowing the compressed air to flow between the valve body 14 and the valve seat 17 to the pneumatic motor.

Figures 5, 5A:
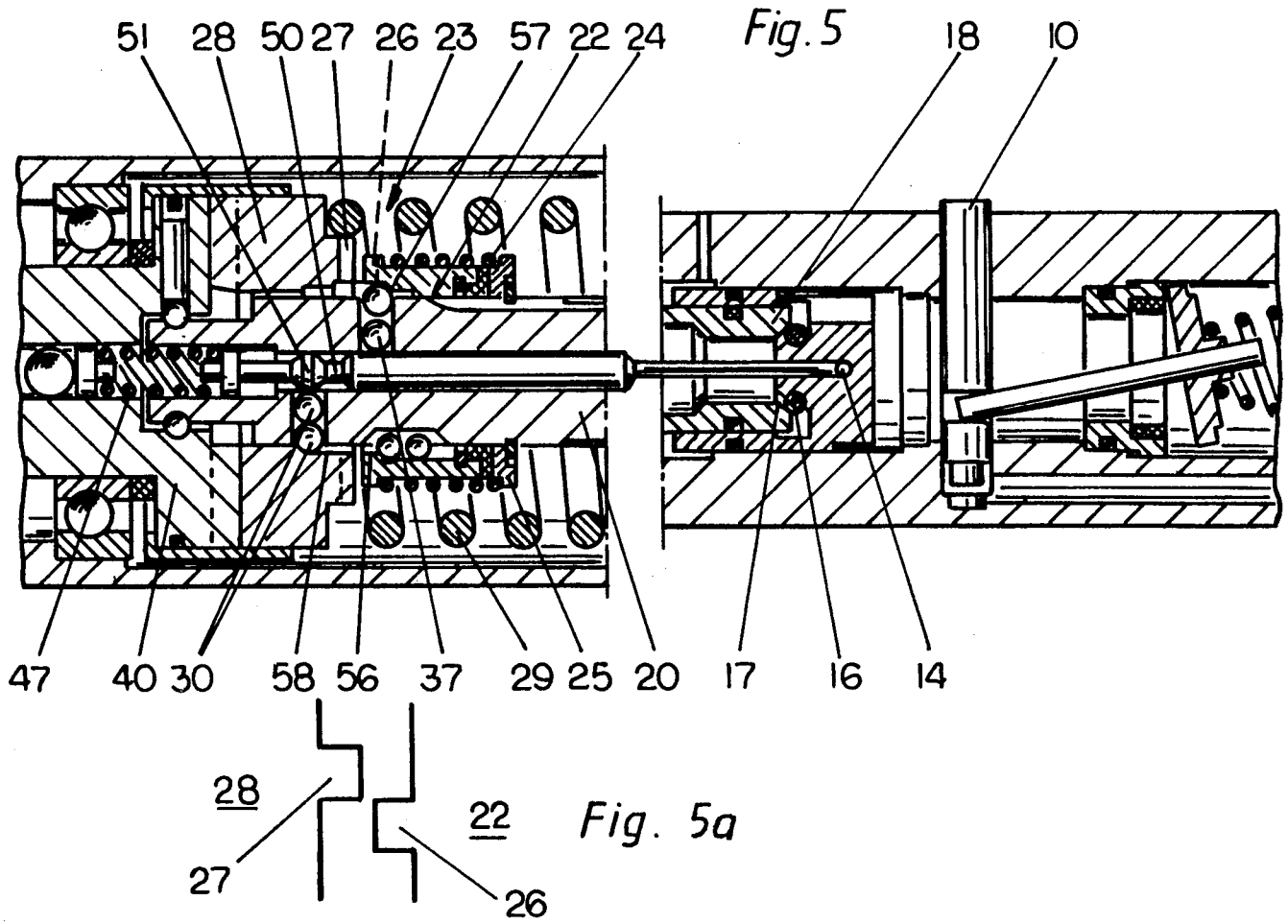

When clutch component 28 is displaced, the driver 22 is moved axially against the tension of compression spring 24 in the manner described. The driver 22 has on the end facing clutch component 28, an end section 56 with an enlarged inner diameter. When the driver 22 is moved, it enters into the area of the stop member 37, which can now be pushed radially outward under the tension of the switching ram 5. During the screwing procedure, the stop members 37 maintain the switching ram in the position shown in FIG. 3 by having the radially inner stop members positioned up against the tapered surface area 52 of the switching ram. In this position, the stop members 37 cannot be moved toward the outside, since the driver 22 prevents them from doing such. However, as soon as the end section 56 of the driver 22 moves into the area of the stop members 37, the differential power is able to move the valve body 14 and thus the switching ram 5 axially, causing the stop members 37 to be pushed radially outwards by the tapered surface area 52 (FIG. 4). At the same time clutch component 28 prevents the stop members 30 from shifting radially outward in the manner described. It is for this reason that the switching ram 5, after its release via the stop members 37, can be moved axially only until its collar 51 butts up against stop members 30. In this position the on-off valve 12 is not yet closed, allowing the compressed air to continue to reach the pneumatic motor and rotate the hollow spindle 20. What this accomplishes is the following: clutch component 28 is rotated farther relative to clutch component 40 via the driver 22 until the clutch coupling jaws 44 of clutch component 28 again assume the contact position to the clutch coupling jaws 43 of clutch component 40. Since the on-off valve 12 is no longer completely opened (see FIG. 3 and 4), the drive torque is sufficient to defeat the friction between clutch coupling jaws 43 and 44, positioned one atop the other, and to return clutch components 28 and 40 of the switching clutch 39 securely to their original position. This position is shown in FIG. 5. Both clutch components 28 and 40 are once again engaged. Since clutch component 28 has been pushed back to its engaged position under tension of the compression spring 29, clutch coupling jaws 26 and 27 of the driver 22 and of clutch component 28 are now disengaged (FIG. 5 and 5*a*). The driver 22 is prevented from being pushed back via the stop members 37, which as always butt up against one shoulder 57 on the changeover from the extended end section 56 to the sleeve component of the driver 22 (FIG. 5). Since clutch component 28 will again be returned to its engaged position, the stop members 30 return via the shoulder 55 into the expanded interior diameter area of clutch component 28. Since the valve body 14 and the switching rod are under the differential power of the compressed air, the stop members 30 can be pushed radially outward into the extended area 58 of the clutch component 28 via collar 51 of the switching ram 5. In this way, the switching ram 5 can be pushed by the differential power against the tension of the compression spring 47 until the valve body 14 together with its seal comes to rest and forms a seal on the valve seat 17 (FIG. 5). The compressed air supply to the pneumatic motor 4 is thus cut off, causing it to shut down.

If the lever is released at this stage (FIG. 1), the ram 10 can return to its original position as shown in FIG. 2. The ram 10 thus opens an air release passage 59 allowing the area between valve 7 and the on-off valve 12 to be ventilated. Compression spring 47 can thus return to its original position together with the valve body 14 via the switching ram 5, as shown in FIG. 2. In so doing, the groove 50 of the switching ram 5 moves into the area of the stop members 37. Since these butt up against the obliquely running shoulder 57 of the driver 22 and the driver moreover is spring-loaded via compression spring 24 in the direction of its engaged position, the stop members 37 are forced radially inward as soon as the groove 50 enters the area of the stop members. The driver 22 can then be returned to its engaged position under tension of compression spring 24, as shown in FIG. 2. At this stage, the tool is ready for another operation.

Since separating the switching clutch 39 does not cause the pneumatic motor 4 to switch off, two things are guaranteed: first, that with a given torque the drive connection to the output shaft 42 is interrupted in the manner described, while at the same time making certain that, second, both clutch components 28 and 40 are engaged securely. As a consequence of the design as described, the switching clutch 39 is returned to its original position following separation, even in the event of soft screws, thus enabling the tool to be used immediately for another operation.

The pre-stress of compression spring 29 and the gradient of front faces 53, 54 of clutch components 28, 40, allow the maximum torque to be determined at which torque transfer is to be interrupted. The steeper the front faces 53, 54 are inclined, the higher becomes the maximum torque.

While a preferred embodiment of the invention has been shown and described, modifications thereof can be made by one skilled in the art without departing from the spirit of the invention.

We claim:

1. A control mechanism for selectively controlling the output shaft of a rotary pneumatic power tool, comprising:

a housing;

a pneumatic input means disposed on said housing for selectively supplying pressurized gases;

a pneumatic valve disposed in said housing adjacent said pneumatic input means to selectively allow the passage of pressurized gas through said housing;

a pneumatic motor disposed within said housing and having a rotor shaft which rotates in response to said passage of pressurized gas;

a separating clutch having a driver coupled to said rotor shaft for synchronous rotational movement therewith;

a switching clutch providing selective mechanical engagement between said separating clutch and the output shaft;

said switching clutch having a torque sensitive means allowing said separating clutch to slip with respect to said switching clutch upon the output shaft reaching a predetermined torque; and said separating clutch having separating means for disengaging said switching clutch from said pneumatic motor in response to said separating clutch slipping with respect to said switching clutch to stop rotation of the output shaft.

2. The control mechanism of claim 1, wherein said driver is axially displaceably mounted concentrically about said rotor shaft for synchronous mechanical engagement with said rotor shaft;

a first clutch component mounted coaxially about said rotor shaft for rotation with respect to said rotor shaft and adjacent said driver;

said driver and said first clutch component having clutch projecting coupling jaws for rotational interference therebetween;

said driver having a first axial position wherein said coupling jaws are in abutting engagement, and a second axial position wherein said coupling jaws are disengaged.

3. The control mechanism of claim 2, wherein said switching clutch includes a second clutch component secured to the output shaft and coaxially disposed with said rotor shaft, said second clutch component being disposed on said first clutch component opposite said driver;

said second clutch component and said first clutch components having complementary ramped coupled jaws projecting therefrom;

said first clutch component having a first axial position wherein said ramped coupled jaws are in engagement, and a second axial position wherein said first clutch member rotates with respect to said second clutch member as said ramped coupled jaw rotationally slip causing a resultant axial displacement of said first clutch member.

4. The control mechanism of claim 3, wherein said first clutch component is axially and rotationally biased against said second clutch component by a compression spring.

5. The control mechanism of claim 3, wherein said driver is axially biased against said first clutch component by a driver spring mounted to said hollow spindle.

6. The control mechanism of claim 3, wherein said rotor shaft includes a positioning means for selective axial movement of said driver and positioning of said pneumatic valve.

7. The control mechanism of claim 6, wherein said rotor shaft is hollow and said positioning means includes a ram shaft received within said hollow rotor shaft and a pair of spherical buffers disposed in said hollow rotor shaft between said ram shaft and said driver;

said ram shaft having a snap ring groove for selectively receiving said buffers; and said driver having a circumferential lip whereby said buffers engage said lip to axially restrain said driver in said second position upon actuation thereof from said first position in response to said first clutch component actuating from its first to second and back to first position.

8. The control mechanism of claim 7, wherein said first clutch component includes an inner circumferential shoulder disposed about said rotor shaft forming a buffer retainer groove diametrically larger than the inner diameter of said first clutch component;

said rotor shaft includes a buffer passage holding spherical buffer balls;

said passage communicating through said rotor shaft to said first clutch component adjacent said groove and said rotor shaft;

said ram shaft having a secondary tapered portion disposed adjacent said snap ring groove forming a cylindrical collar on said ram shaft;

said ram shaft terminating opposite said first clutch component in said pneumatic valve;

such that axial cycling of said first clutch component from said first position to said second position causes said buffers adjacent said river to exit said snap ring groove, thereby permitting axial movement of said ram shaft to move said valve toward a closed position, said buffers adjacent said first clutch component moving into said secondary tapered portion upon said cycling of said first clutch component to engage said cylindrical collar and prevent complete closing of said valve, and cycling of said first clutch component from said second position to said first position aligning said buffer retainer groove with said buffer balls engaged with said cylindrical collar permitting said balls to radially disengage said cylindrical collar thereby permitting said ram shaft to fully axially actuate to close said valve.

9. The control mechanism of claim 8, wherein said ram shaft further includes a biasing means for controlling the actuation of said valve.

10. The control mechanism of claim 9, wherein said biasing means is a spring mounted to the end of said ram shaft opposite said valve;

said valve having a valve body mechanically linked to said ram shaft and a valve seat for receipt of said valve body;

said spring biasing said ram shaft to displace said valve body from said valve seat to permit passage of pneumatic gases through said valve; and the pneumatic gases applying a pressure to the difference in areas of said valve body exposed to the said pneumatic input means and the area adjacent the valve seat, said pressure tending to bias the ram shaft against said spring.

11. The control mechanism of claim 10 wherein said pneumatic input means is a switchable valve in communication with a pressure relief bleed orifice in said housing.

12. The control mechanism of claim 11 whereby closing said pneumatic input means after cycling of the clutch members removes the pressure on the valve thereby permitting said biasing means to axially actuate said ram shaft to open said valve.

13. Apparatus for selectively controlling the output shaft of a rotary pneumatic power tool, comprising:

a housing;

a pneumatic valve disposed in said housing and adapted to receive pressurized gas, said pneumatic valve having an open position allowing the passage of pressurized gas through said housing, a partially open position limiting the passage of pressurized gas through said housing, and a closed position preventing the passage of pressurized gas through said housing;

a pneumatic motor disposed within said housing for rotating a rotor shaft in response to the passage of pressurized gas through said pneumatic valve;

a ram shaft extending axially through said housing and having one end seated in said pneumatic valve, said ram shaft having a first axial position in said open position, a second axial position in said partially open position, and a third axial position in said closed position;

a first biasing means for biasing said ram shaft and said pneumatic valve to said open position;

a first clutch member axially slidably coupled to said rotor shaft for synchronous rotational movement therewith;

a second clutch member axially adjustably disposed on said rotor shaft;

said first and second clutch members having coupling jaws, said coupling jaws having an engaged and an unengaged position;

second biasing means for biasing said first clutch member toward said second clutch member;

a third clutch member rotatably disposed on said rotor shaft and torqued to the output shaft;

said second and third clutch members having obliquely faced jaws, said obliquely faced jaws having a meshed and an unmeshed position;

third biasing means for biasing said obliquely faced jaws into the meshed position;

first stop members for positioning said ram shaft in said first axial position and positioning said first clutch member in said second axial position;

second stop members for positioning said ram shaft in said second axial position; whereby in said open position, said coupling jaws are in said engaged position and said obliquely faced jaws are in said meshed position to transmit torque from said pneumatic motor to the output shaft, and said first stop members and said second biasing means position said first clutch member in an unexpanded position on said ram shaft;

upon reaching a predetermined torque on the output shaft, said third biasing means is overcome causing said obliquely faced jaws to cam to the unmeshed position and shift said first and second clutch members to a contracted position on said ram shaft, said first stop members holding said first clutch member in said contracted position and allowing said ram shaft to move to said second axial position, said second stop members engaging said ram shaft to prevent said ram shaft from moving from said second axial position to said third axial position, said movement of said ram shaft to said second axial position causing said pneumatic valve to move to said partially open position;

in said partially open position, the reduced torque of said pneumatic motor due to the limited passage of pressurized gas allows said obliquely faced jaws to return to said meshed position and thus said second clutch member to said expanded position, said first clutch member remains in said contracted position by said first stop members and thus said coupling jaws move to said unengaged position, said second step members releasing said ram shaft upon the axial movement of said second clutch member to allow said ram shaft to shift to said third axial position and thus close said pneumatic valve; and in the closed position, said first biasing means moves said ram shaft to said first axial position causing said first stop members to release said first clutch member, said first clutch member moved to said expanded position by said second biasing means where said coupling jaws return to said engaged position.

14. Apparatus for selectively controlling the output shaft of a rotary pneumatic power tool, comprising:

a housing;

a pneumatic valve disposed in said housing adapted to receive pressurized gas and having an open position to allow the passage of the pressurized gas through said housing and a closed position to prevent the passage of the predetermined gas;

a pneumatic motor disposed within said housing and connected to one end of a rotor shaft which rotates in response to the passage of pressurized gas through said pneumatic valve;

said rotor shaft having a longitudinal bore receiving a ram shaft having one end seated in said pneumatic valve;

first biasing means for biasing said ram shaft and thus said pneumatic valve to the open position;

a first clutch member coupled to said rotor shaft for synchronous rotational movement therewith by first balls housed in axially adjacent impressions in said first clutch member and rotor shaft;

a second clutch member adjacent said first clutch member and disposed around and axially adjustable to said rotor shaft;

said first and second clutch members having first and second coupling jaws, respectively, for transmitting torque;

a second biasing means for biasing said first clutch member toward said second clutch member causing engagement of said first and second coupling jaws;

a third clutch member rotatably disposed on another end of said rotor shaft and torqued to the output shaft;

said second and third clutch members having first and second obliquely faced jaws, respectively, for selectively transmitting torque therebetween;

third biasing means for biasing said first obliquely faced jaw against said second obliquely faced jaw with a predetermined force;

said rotor shaft having a first radial bore in which are housed first radially adjustable balls;

said ram shaft having a groove for alignment and communication with said first radial bore and said first radially adjustable balls in a first axial position and a second axial position where said groove is nonaligned with said first radial bore;

said first clutch member having a major and minor inner diameter area for receiving said first radially adjustable balls in said minor diameter are in said first axial position and for receiving said first radially adjustable balls in said major diameter area in said second axial position;

said rotor shaft having a second radial bore in which are housed second radially adjustable balls;

said ram shaft having a reduced diameter portion adjacent said second radial bore;

said second clutch member having an impression for receiving said second radially adjustable balls when said ram shaft is in said second axial position;

in said open position, said ram shaft is moved axially by said pneumatic valve until said ram shaft is in said first axial position and said first radially adjustable balls prevent further axial movement, the first and second coupling jaws and obliquely faced jaws and engaged such that torque is transmitted from said pneumatic motor to the output shaft;

upon reaching a predetermined torque on the output shaft, said predetermined force of said third biasing means is overcome causing said obliquely faced jaws to slip and said first and second clutch members move axially on said rotor shaft against the force of said third biasing means, thereby interrupting the rotation of the output shaft, said axial movement of said second clutch member forces said second radially adjustable balls out of said impression of said second clutch member and radially inward into said reduced diameter portion of said ram shaft to thereby limit the axial movement of said ram motor to prevent the closing of said pneumatic valve, further said major diameter area of said first clutch member becomes aligned with said first radial bore to receive said first radially adjustable balls and allow said ram shaft to move to said second axial position, said movement limited by said second radially adjustable balls, the movement of said ram shaft reducing the opening of said pneumatic valve;

the reduced flow of pressurized gas through said pneumatic valve allowing said first and second obliquely faced jaw to return to their engaged position and said third biasing means forcing said second clutch member to return to its engaged position with said third clutch member, said first radially adjustable balls preventing said second biasing means from returning said first clutch member and causing said coupling jaws of said first and second clutch members to become disengaged, said second radially adjustable balls returning to their position within said impression of said second clutch member, said ram shaft thereby moving further axially to close said pneumatic valve;

upon closing said pneumatic valve, said first biasing means returns said ram shaft to said first axial position and said first radially adjustable balls are received again in said groove of said ram shaft, said second biasing means forcing said first clutch member into engagement with said second clutch member.

* * * * *

UNITED STATES PATENT AND TRADEMARK OFFICE

CERTIFICATE OF CORRECTION

PATENT NO. : 5,060,772

DATED : October 29, 1991

INVENTOR(S) : Anders, et al.

It is certified that error appears in the above-indentified patent and that said Letters Patent is hereby corrected as shown below:

Col. 8, line 29 ... Delete "river" ... and insert --driver--.
Col. 9, line 53 ... Delete "unexpanded" ... and insert --expanded--.
Col. 10, line 9 ... Delete "step" ... and insert --stop--.
line 28 ... Delete "predetermined" and insert --pressurized--.
Col. 11, line 3 ... Delete "are" ... and insert --area--.

Signed and Sealed this

Twenty-third Day of November, 1993

*Attest:*

*Attesting Officer*

BRUCE LEHMAN

*Commissioner of Patents and Trademarks*